US007575239B2

(12) United States Patent
Cohen

(10) Patent No.: US 7,575,239 B2
(45) Date of Patent: Aug. 18, 2009

(54) PLAYERS CHOICE BLACKJACK

(76) Inventor: Jeffrey S. Cohen, 806 Rancho Coast Way, Henderson, NV (US) 89002-9146

( * ) Notice: Subject to any disclaimer, the term of this patent is extended or adjusted under 35 U.S.C. 154(b) by 0 days.

(21) Appl. No.: 11/775,783

(22) Filed: Jul. 10, 2007

(65) Prior Publication Data

US 2008/0012226 A1 Jan. 17, 2008

Related U.S. Application Data

(60) Provisional application No. 60/807,025, filed on Jul. 11, 2006.

(51) Int. Cl.
*A63F 1/00* (2006.01)

(52) U.S. Cl. ..... 273/292; 273/274

(58) Field of Classification Search ..... 273/292, 273/274, 309; 463/12
See application file for complete search history.

(56) References Cited

U.S. PATENT DOCUMENTS

| | | | | |
|---|---|---|---|---|
| 5,174,579 | A | 12/1992 | Griffiths | |
| 5,257,810 | A | 11/1993 | Schorr | |
| 5,275,416 | A | 1/1994 | Schorr | |
| 5,413,353 | A | 5/1995 | Demarest | |
| 5,615,888 | A | 4/1997 | Lofink | |
| 5,649,705 | A | 7/1997 | String | |
| 5,653,444 | A | 8/1997 | Dahl | |
| 5,673,917 | A | 10/1997 | Vancura | |
| 5,799,946 | A * | 9/1998 | Groussman | 273/292 |
| 5,836,586 | A | 11/1998 | Marks | |
| 6,079,712 | A | 6/2000 | Eaton | |
| 6,113,102 | A | 9/2000 | Marks | |
| 6,302,396 | B1 | 10/2001 | Eaton | |
| 6,488,284 | B2 | 12/2002 | Webb | |
| 6,575,464 | B1 | 6/2003 | Fertitta | |
| 2004/0155405 | A1 * | 8/2004 | Marks et al. | 273/274 |

* cited by examiner

*Primary Examiner*—Benjamin H Layno
(74) *Attorney, Agent, or Firm*—John C. Lambertsen; Kenehan & Lambertsen, Ltd.

(57) ABSTRACT

A method of playing a blackjack game permits a player to place an initial wager on either the player's hand or on the dealer's hand. If placed on the player's hand, play continues under traditional blackjack rules. If the initial wager is placed on the dealer's hand, play of the player's hand is substantially in accordance with the house rules for play of the dealer's hand. If both the player's hand and the dealer's hand bust when the bet is on the dealer's hand, a portion of the initial player bet is forfeited to maintain a house advantage.

18 Claims, 1 Drawing Sheet

PLAYERS CHOICE BLACKJACK

CROSS-REFERENCE TO RELATED APPLICATION

This application claims the benefit of U.S. Provisional Application Ser. No. 60/807,025, filed Jul. 11, 2006.

TECHNICAL FIELD

The embodiments of the invention disclosed herein relate to casino gaming, and more particularly, to playing card games and methods of play for a blackjack-type card game.

BACKGROUND ART

Whether originating in Italy or France, for the past 100 years "blackjack" or "21" has been the most popular casino table game in the United States. Its popularity is due to a variety of factors, including not many rules of play, it is based upon skill not just luck, and minimum bets can be small without affecting the odds of winning. Additionally, in the 1950's and 1960's, many books were written attempting to explain basic strategies of play to improve a player's odds of winning at blackjack.

A player's objective in blackjack is to obtain a hand of cards having point values totaling as close to 21 as possible, without going over. After initial bets are placed, players are dealt two cards each, typically face up. Numbered cards are counted at the face value, face cards are counted as "10," and Aces can count as either "1" or "11." An Ace and a card counting as "10" dealt as the initial two cards are defined to be a "blackjack," and unless the dealer is also dealt a blackjack, that player is entitled to an enhanced payout on wagers placed.

The dealer also obtains two cards, but typically only the first card is revealed. The play proceeds around the table, with players choosing to draw additional cards ("hit") to increase their point total or stay with their current cards ("stand"). After all players have completed play, the dealer turns over the hidden, second card, and then begins play of the hand. Unlike the players, the dealer is required to play according to strict rules determining whether to hit or stand. These rules may vary from one gaming establishment to another—the majority requiring a hit on point totals up to "16," and standing on "17." Less favorable to the players is the rule that the dealer must "hit" on a "soft 17," which occurs when an Ace is included in the "17" total, since an Ace could also equal "1" (thus, an Ace and a "6" could total either "17" or "7").

Should the dealer bust (exceed a point total of "21"), each player who did not bust wins. When the dealer does not bust, the value of each non-busting player hand is compared to the dealer's hand, and the player wins if their point total exceeds that of the Dealer. Where the player and dealer have hands of equal value, it is called a "push" and the player's initial wager is returned.

One area of advantage to the house/dealer is the requirement that play of the dealer's hand follows completion of player play. Should a player "bust" during this period that player is immediately considered to have lost, and the bet and all cards are immediately discarded. Should the dealer later also "bust," there is no revisiting any of the earlier player busts. This order and manner of play materially assists the house in maintaining an edge over the players.

Traditional Blackjack also contemplates the provision of several additional playing and betting options, such as insurance, doubling down, and splitting pairs. "Insurance" is a side bet offered a player when the dealer's visible card is an Ace. The player may wager up to ½ of the initial wager on "insurance," which pays at 2:1 if the dealer's down or hole card has a value of 10 (giving the dealer a "natural" Blackjack) . Since the actual odds of the dealer obtaining a natural are close to 2.25:1, insurance only makes sense for a player if he or she has some sense (such as through card counting) of the dealer's hole card.

"Doubling down" occurs where a player doubles the initial wager, takes exactly one more card, and then stands. "Splitting" or "splitting pairs" is available where both cards have the same value, and when elected, the player doubles the initial wager and each card is then considered to be the first card in a new hand.

These features make the basic game a bit trickier, and many involve side bets that can increase the stakes of the game. For the more skilled players, these additions can assist in reducing the house advantage. For those of less skill, these additions only act to further increase the house advantage as one or more are misplayed.

To the average player, there appear times where the dealer is constantly winning, and in discouragement, they leave the table. To address this perception, others have proposed permitting a player to bet on the dealer, and thereby keeping such players at the table over a longer period of time. Should such a bet be made, the play of the players hand is governed by the same rules of play as the dealer's hand, and in fact, it is played by the dealer in much the same manner as the dealer plays his or her own hand.

Of course, the house cannot permit a player to stand exactly in the same place as a dealer—that player would essentially enjoy "the house advantage," while the house would not. To avoid that result, one version requires players betting on the dealers to pay a "commission" on the bet—or, alternatively, causing the player to automatically lose upon obtaining a card value of 17 when betting on the dealer. Another version varies the hit/stand rules, depending upon the value of the dealer's up (or visible) card on the initial deal. Neither of these alternatives is viewed as player friendly. In one case, the player has to pay an out-of-pocket premium to bet on the dealer—in the other, the player's cards are no longer played as if playing the dealer, suggesting an immediate house advantage. It would be desirable to offer a player an opportunity to bet on the dealer's hand and win with the dealer—yet in a manner that continues to provide the house with a betting advantage.

DISCLOSURE OF THE INVENTION

According to aspects of embodiments of the present invention, a blackjack player is presented with an option to place an initial wager on either the player's own hand or a wager on the dealer's hand, preferably before the dealing of any playing cards. If the initial wager is placed on the player's own hand, the blackjack game proceeds under traditional rules of play. Alternatively, where the initial wager is placed upon the dealer's hand, the player will no longer control play of the player's hand, which instead will be governed by rules of play that are substantially the same as those for the dealer's hand.

Another aspect in accordance with embodiments of the present invention provides for resolving wagers when the player places the initial wager on the dealer's hand and the hands of both the player and the dealer bust. All or a portion of the player's initial wager is forfeited to preserve a house advantage.

A further aspect in accordance with embodiments of the present invention is a method of playing a blackjack game between at least one player and a dealer using at least one standard deck of playing cards, comprising the steps of: each player placing a first wager, said first wager of each player identified as either a player wager or a dealer wager; dealing each player placing a first wager an initial hand of two playing cards and dealing an initial hand of two playing cards to the dealer; establishing for each player a predetermined set of rules governing play solely in response to whether said first wager is identified as a player wager or a dealer wager; dealing additional cards to each player according to the respectively established set of rules governing play to obtain a final player hand count; dealing additional cards to the dealer according to a predetermined set of house rules to obtain a final dealer hand count; comparing the final dealer hand count to each final player hand count where required under the respectively established set of rules governing play; and awarding each player obtaining a winning outcome.

A still further aspect in accordance with embodiments of the present invention is a method of playing a blackjack game between at least one player and a dealer, with at least one deck of fifty-two playing cards and a table layout having a playing surface with a plurality of player positions, each of which include a select/player wagering area and a select/dealer wagering area, comprising the steps of: each player placing an initial bet in either the select/player wagering area or the select/dealer wagering area; dealing an initial two-card hand to each player and an initial two-card hand to the dealer; playing out the initial two-card hand of each player in accordance with a first set of rules if the initial bet of the player is in the select/player wagering area or in accordance with a second set of rules if the initial bet of the player is in the select/dealer wagering area; playing out the initial two-card hand of the dealer in accordance with a predetermined set of house rules; determining a final hand count for each player and for the dealer; comparing the final dealer hand count to the final hand count for each player under said first set of rules if the initial bet of the player is in the select/player wagering area or in accordance with said second set of rules if the initial bet of the player is in the select/dealer wagering area; and awarding each player obtaining a winning outcome.

These and various other advantages and features of the present invention are pointed out with particularity in the claims. Reference should also be had to the drawing which forms a further part hereof, as well as to the accompanying descriptive matter in which are illustrated and described in various examples of with the invention.

BRIEF DESCRIPTION OF THE DRAWING

The sole FIGURE is a partial plan view showing a group of indicia on a playing surface whereon a wagering game is played in accordance with a preferred embodiment of the present invention.

DETAILED DESCRIPTION OF THE PREFERRED EMBODIMENTS

Figure 1:
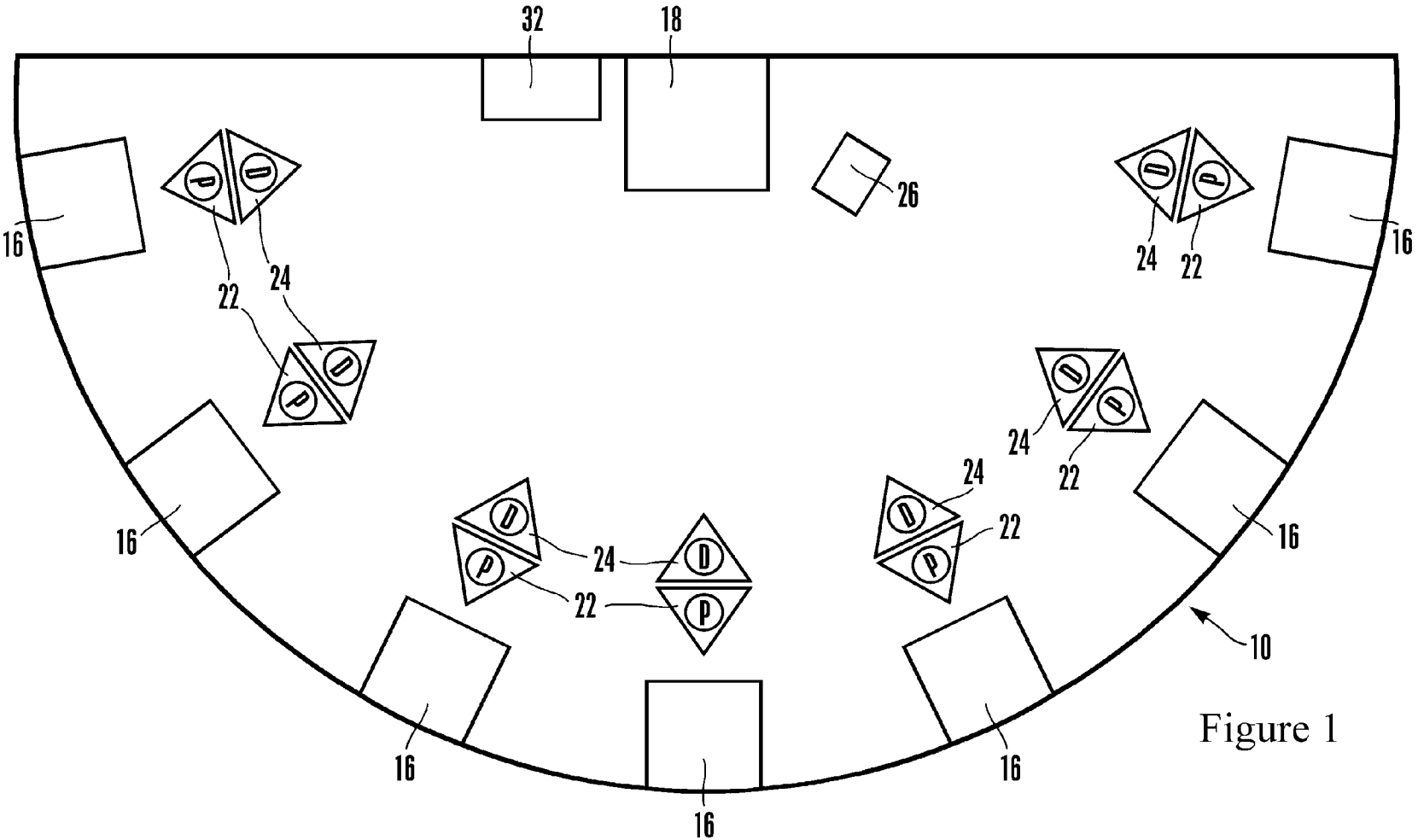

Reference is now made to the drawing wherein like numerals refer to like indicia throughout. In the FIGURE, a playing surface 10 is provided with a plurality of inscribed geometric shapes to assist in the play of a card game described hereinafter.

A plurality of player positions 16 and a dealer position 18 are spaced opposite one-another on the playing surface 10. Each of the player positions 16 is provided with a wagering area that defines two separate wagers: a select/player wagering area 22 and a select/dealer wagering area 24. As will be discussed in greater detail hereinafter, a player may only place a wager in one of the two wagering areas, and by so doing, elects to wager either on that player's hand or on the dealer's hand.

A preferred embodiment of the present invention contemplates the use of multiple decks playing cards placed in a playing card shoe 26. Each of these decks of playing cards comprises a standard deck minus any jokers, with the cards located in the playing card shoe 26 used to deal each of the player's hands as well as the dealer's hand. A chip rack 32 is located adjacent the dealer position 18 and holds playing chips of typical gambling denominations.

As mentioned above, it is presently contemplated that the game will be played with multiple 52-card decks of playing cards—although it is to be understood and appreciated that play with a single deck also lies within the present invention.

Play begins with a first player making an initial wager on either that player's own hand or on the dealer's hand to win. After all initial wagers are made, the dealer commences the dealing of the playing cards. Each player is dealt two playing cards face up, and the dealer is likewise dealt two cards; however, only one of the dealer's cards is placed face up.

If a player has made an initial wager on that player's hand, i.e., placing the bet on the select/player wagering area 22, also denoted "P," a game of Blackjack is then played out according to traditional rules. That player may split pairs (Aces can only be split once and receive only one card), double (also termed "double down") or splitting cards of equal value.

If the player's two cards form a "Blackjack," the player is paid 3 to 2. If the dealer shows an Ace, insurance is offered. After given the chance to hit/stand, the player's hand wins or loses on its own merits against the dealer's hand. House rules require the dealer to hit on a soft seventeen. Surrender is not contemplated under the present invention.

In contrast, should the player have placed a bet that the dealer's hand will win—i.e., placing the bet on the select/dealer wagering area 24 (denoted with a "D"), of necessity play of the game differs by removing control of play from the player. To do otherwise would permit a player to play in a manner that might greatly enhance the chance of the dealer's hand winning. For example, if the player were allowed to "hit" at will, the player could always "bust,"—or, the player could always "stand," even with a low point total. Thus the player is restricted to "hitting" or "standing" in accordance with the dealer's rules—providing a level playing field, even if that is not exactly representative of what might have happened had the player played the hand as if under a traditional betting scheme.

Under the present invention, the dealer-betting player must play according to "house" rules, which require the player to "hit" 16 and below, hit a soft 17, and "stand" (not draw) on a hard 17 and above. These are essentially the same play restrictions placed on the play of the dealer's hand.

However, even with such restrictions, were the player to have the option of splitting pairs or doubling down, events such as splitting "5's" or doubling low totals, might be expected to occur, giving the dealer's hand an edge. Thus if the player elects to bet on the dealer's hand, the player cannot split a pair or double down. On the other hand, since "insurance" is a side bet, if the dealer shows an Ace, the players, whether they have wagered on the player side or the dealer side, are offered an opportunity for insurance.

If the player receives a Blackjack and the dealer does not, then the player (who has bet on the dealer's hand) loses. If the dealer receives a Blackjack and the player does not then the player wins—this time even money. If both the player and the dealer receive Blackjacks, then it is a push; no money changes hands.

That leaves remaining the manner in which busted hands are settled. In traditional Blackjack, the player immediately loses upon busting a hand, the later results of a dealer bust (or not) are irrelevant. If the dealer's hand busts and the player's does not, then the wager on the dealer's hand loses.

Where the player bets upon the dealer's hand, should the player's hand bust then, unlike regular Blackjack, the wager is not settled until the dealer completes play of the dealer's hand. If the dealer's hand does not bust, the dealer's hand is the winner, and the player betting on the dealer's hand wins.

Should both the dealer's and player's hands bust, and were it to be handled as a push, then both player and dealer would be playing exactly the same game, resulting in a zero house advantage. As noted previously, in normal Blackjack the dealer's hand would be deemed the winner, giving the dealer/house an advantage. Thus under the present invention, when both the player and dealer bust, where the player has bet on the dealer, the house must collect from the "dealer" wager in order to maintain a house advantage. Based upon a computer simulation of 200 million trials, if the entire wager is collected, the house advantage computes to 8.19%, and if only ½ the wager is collected, the house advantage is 4.09%.

The rules and play of the game are described below in a series of examples.

Example 1

Player begins play by placement of a wager in the select/player wagering area 22. The Dealer deals two cards, face up, to each participating player, Player receives an Ace and a Jack. Player has bet on Player's hand, so the normal rules of Blackjack apply. The Ace and Jack constitute a Blackjack, and assuming the Dealer does not also have a Blackjack, Player wins 3:2 for wagers placed.

Example 2

Player begins play by placement of a wager in the select/player wagering area 22. The Dealer deals two cards, face up, to each participating player, Player receives an Ace and a Six, and the Dealer receives a Six and a hidden card. Player has bet on Player's hand, so the normal rules of Blackjack apply. The Ace and Six constitute a soft 17—the Ace being valued as either 11 or 1. The Player may either obtain additional cards ("Hit") or elect not to obtain any additional cards ("Stand").

Player elects to "stand," and Dealer turns over the hidden card, which is an Ace—the dealer also has received a soft 17. House rules require the dealer to "Hit" on a soft seventeen, and the next card is a "Five" totaling 22 and the house would now count the Ace as one for a total of 12. At any hard value under 16 the Dealer is required to hit, and the next card is a Jack. The Dealer has busted and the Player wins even money on wagers made.

Example 3

Player begins play by placement of a wager in the select/dealer wagering area 24. The Dealer deals two cards, face up, to each participating/wagering player. Player receives an Ace and a Six, and the Dealer receives a Six and a hidden card. Player has bet on Dealer's hand, so specialized rules of play apply to the play of the Players hand.

House rules require a Hit on a soft seventeen, the Dealer deals Player a Five, which provides a point total of 12 with the Ace counting as 1 point. Hard values of 16 points and under require a Hit, and the next card is a Jack—the Player's hand has busted.

The Dealer turns over the hidden card, which is an Ace. The House rules require a Hit on soft seventeen; the Dealer receives a Five—providing a point total of 12. Hard values of 16 points and under require a Hit, and the next card is a Queen—the Dealer's hand has also busted.

Under House rules, a tie/push where both hands bust and the Player has bet upon the Dealer results in the Player losing ½ of the wager made. This preserves the House advantage of approximately 4.09%. Should the wager not be able to be equally divided, the house will take the extra money. For example, suppose a $6.50 wager is made and both the player and dealer bust. The house will take the $3.50, leaving the player $3.00.

Although described in the context of a live wagering game with a dealer at a gaming table, the present invention can easily be adapted for play on an electronic gaming machine, in interactive electronic or video form with automatic coin or paper tickets, betting symbols, and payout capability, with symbols for cards, wagers and score-keeping displayed electronically. It is to be understood and appreciated that such an adaptation and manner of use lies within the scope of the present invention.

My invention has been disclosed in terms of a preferred embodiment thereof, which provides a wagering game associated with the game of Blackjack that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A method of playing a blackjack game between at least one player and a dealer using at least one standard deck of playing cards, comprising the steps of:

each player placing a first wager, said first wager of each player identified as either a player wager or a dealer wager;

dealing each player placing a first wager an initial hand of two playing cards and dealing an initial hand of two playing cards to the dealer;

establishing for each player a predetermined set of rules governing play solely in response to whether said first wager is identified as a player wager or a dealer wager;

dealing additional cards to each player according to the respectively established set of rules governing play to obtain a final player hand count;

dealing additional cards to the dealer according to a predetermined set of house rules to obtain a final dealer hand count;

comparing the final dealer hand count to each final player hand count where required under the respectively established set of rules governing play; and awarding each player obtaining a winning outcome, and only when said first wager is identified as a dealer wager, and not as a player wager, and when both the player and the dealer bust, an amount of the first wager is forfeited.

2. A method according to claim 1, wherein a plurality of standard decks of playing cards are used.

3. A method according to claim 1, wherein each said first wager is exclusively identified as either a player wager or a dealer wager.

4. A method according to claim 3, wherein placement of said first wager is either in a select/player wagering area or a select/dealer wagering area.

5. A method according to claim 1, wherein a traditional set of rules for playing blackjack is established where said first wager is identified as a player wager.

6. A method according to claim 5, wherein a set of rules removing control of play from the player is established where said first wager is identified as a dealer wager.

7. A method according to claim 6, wherein a player cannot split a pair or double down where said first wager is identified as a dealer wager.

8. A method according to claim 6, wherein said set of rules removing control of play from the player is substantially the same as said predetermined set of house rules used to obtain said final dealer hand count.

9. A method according to claim 8, only when said first wager is identified as a dealer wager, and not as a player wager, and when both the player and the dealer bust, the entire amount of the first wager is forfeited.

10. A method according to claim 9, wherein one-half of the first wager is forfeited.

11. A method of playing a blackjack game between at least one player and a dealer, with at least one deck of fifty-two playing cards and a table layout having a playing surface with a plurality of player positions, each of which include a select/player wagering area and a select/dealer wagering area, comprising the steps of:

each player placing an initial bet in either the select/player wagering area or the select/dealer wagering area;

dealing an initial two-card hand to each player and an initial two-card hand to the dealer;

playing out the initial two-card hand of each player in accordance with a first set of rules if the initial bet of the player is in the select/player wagering area or in accordance with a second set of rules if the initial bet of the player is in the select/dealer wagering area;

playing out the initial two-card hand of the dealer in accordance with a predetermined set of house rules;

determining a final hand count for each player and for the dealer;

comparing the final dealer hand count to the final hand count for each player under said first set of rules if the initial bet of the player is in the select/player wagering area or in accordance with said second set of rules if the initial bet of the player is in the select/dealer wagering area; and awarding each player obtaining a winning outcome, and only when the initial bet is identified as a select/dealer, and not as a select/player wager, and when the initial two-card hand of a player is played out in accordance with said second set of rules and both the player and the dealer bust, an amount of the initial bet place by the player is forfeited.

12. A method according to claim 11, wherein each player places a single initial bet exclusively in said select/player wagering area or exclusively in said select/dealer wagering area.

13. A method according to claim 11, wherein at least one card of each initial two-card hand is dealt face-up.

14. A method according to claim 13, wherein the initial two-card hand of each player is dealt face-up.

15. A method according to claim 11, wherein said first set of rules comprise traditional blackjack rules.

16. A method according to claim 11, wherein said second set of rules remove control of play from the player.

17. A method according to claim 16, wherein playing out the initial two-card hand of each player under said second set of rules is substantially the same as playing out the initial two-card hand of the dealer.

18. A method according to claim 17, wherein when the initial two-card hand of a player is played out in accordance with said second set of rules and both the player and the dealer bust, one-half of the initial bet placed by the player is forfeited.

* * * * *